United States Patent [19]

Vallieres

[11] Patent Number: 4,887,621

[45] Date of Patent: Dec. 19, 1989

[54] COMBINATION TOOTHBRUSH AND DENTAL FLOSS HOLDER

[76] Inventor: Louis Vallieres, 5470 Braesvalley #322, Houston, Tex. 77096

[21] Appl. No.: 189,083

[22] Filed: May 2, 1988

[51] Int. Cl.[4] ..... A45D 44/18

[52] U.S. Cl. ..... 132/309; 132/324

[58] Field of Search ..... 132/84 A, 92 R, 84 R, 132/89, 91, 92 A, 308, 309, 323, 324, 325

[56] References Cited

U.S. PATENT DOCUMENTS

| | | | |
|---|---|---|---|
| 1,473,766 | 11/1923 | Healy | 132/309 |
| 1,646,082 | 10/1927 | Dailey | 132/309 |
| 1,773,041 | 8/1930 | Healy | 132/311 |
| 2,233,522 | 3/1941 | Fickle | 132/300 |
| 2,233,936 | 4/1941 | Campbell | 132/325 |
| 2,468,298 | 4/1949 | Kahn | 132/309 |
| 2,468,733 | 5/1949 | Boulicault | 132/311 |
| 2,601,244 | 6/1952 | Boulicault | 132/309 |
| 3,782,397 | 1/1974 | McCord | 132/309 |
| 3,853,134 | 12/1974 | McCord | 132/300 |
| 3,890,986 | 6/1975 | Gerlich | 132/309 |
| 3,906,963 | 9/1975 | Jenkins et al. | 132/325 |

*Primary Examiner*—John J. Wilson

*Attorney, Agent, or Firm*—Fulbright & Jaworski

[57] ABSTRACT

A hollow handled toothbrush that includes a detachable toothbrush and includes a cavity for receiving a spool of dental floss. A support platform is releasably attached for loading and unloading spools of dental floss into the cavity on spool guides. The platform includes a dental floss opening and supports a cutter for cutting the dental floss. A removable screw cap covers and protects the cutting blade and dental floss.

6 Claims, 2 Drawing Sheets

COMBINATION TOOTHBRUSH AND DENTAL FLOSS HOLDER

BACKGROUND OF THE INVENTION

It is known to provide a combination toothbrush and dental floss holder.

The present invention is directed to various improvements in such a combination by providing a handle diameter and length designed to provide maximum orthopedic gripping action by the user, ease of removal and replacement of the brush attachment to provide brush styles as desired by the user, ease of storage, dispensing and replacing of dental floss, in which the floss spool is easily rotatable without rattling and an end cap is provided for maintaining the cleanliness of the floss and floss cutter.

SUMMARY

The present invention is directed to a combination toothbrush and dental floss holder which includes a body having first, second and third parts. The first part is a toothbrush attachment and the second part includes a cavity for receiving a spool of dental floss and has a first end releasably connected to the toothbrush attachment. The second part includes a first dental floss guide adjacent the first end for rotatably supporting one end of a spool of dental floss. The third part is a cap for attachment to the second end of the second part. A support platform having first and second sides is releasably attached to the second end of the second part by a first threaded connection and is releasably attached to the cap by a second threaded connection. The first side of the platform includes a second dental floss guide for rotatably supporting a second end of a spool of dental floss. The platform includes a dental floss opening for passage of dental floss from the first side of the second side of the platform and a cutter is positioned on the second side of the support platform for cutting the dental floss.

Still a further object of the present invention is wherein the first and second threaded connections are oppositely directed threads for allowing removal of the cap without loosening of the support platform. Preferably the first threaded connection is a square thread for ease of makeup and release.

Still a further object of the present invention is the provision of a resilient washer positioned on the second dental floss guide for supporting the second end of a dental floss spool for preventing rattling of the dental floss. Preferably, a low friction washer is positioned on the second dental floss guide adjacent the resilient washer for engaging the second end of the dental floss spool for allowing ease of rotation of the spool.

Yet a still further object of the present invention is wherein the second side of the support platform includes an outwardly directed projection supporting the cutter. Preferably the projection includes locking notches and the cutter includes a metal base having resilient fingers for engaging the notches and holding the cutter on the projection.

A still further object of the present invention is wherein the support platform includes oppositely positioned indentations for engagement for threading the platform into and out of the second part.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENT

Figure 1:
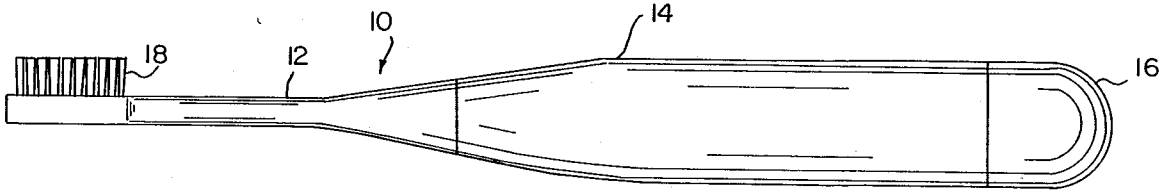
FIG. 1 is an elevational view of the combination toothbrush and dental floss holder of the present invention.
Figure 2:
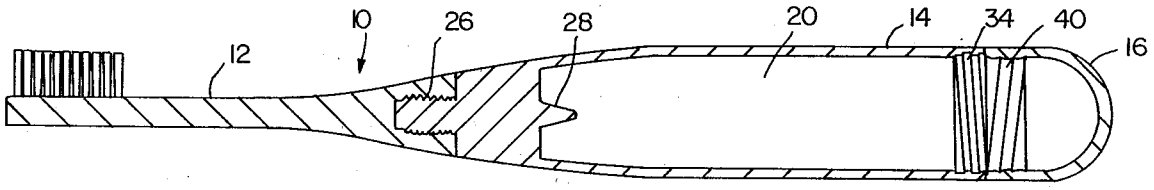
FIG. 2 is a cross-sectional view of the device of FIG. 1 with the insides removed for clarity.
Figure 3:
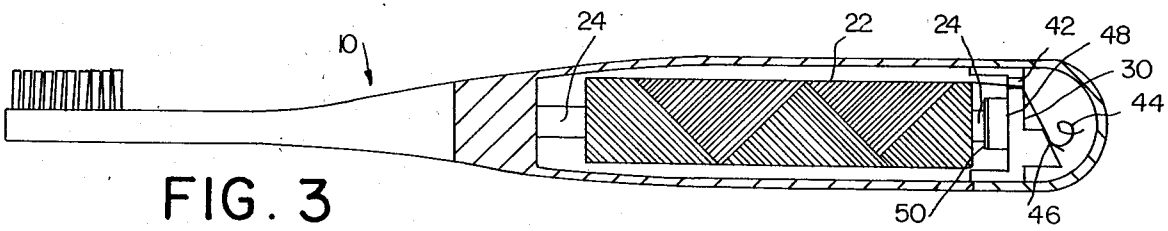
FIG. 3 is an elevational view, partly in cross-section, of the device of FIG. 1.

Referring now to the drawings and particularly to FIGS. 1–3, the present invention is generally indicated by the reference numeral 10 and generally includes a body having a first part 12, a second part 14, and a third part 16. The first part 12 is a toothbrush attachment having a brush 18 which may be of any desired material and style. The second part 14 is generally cylindrically shaped and includes a cavity 20 for receiving a spool of dental floss 22 having spool ends 24. The second part 14 has first and second ends in which the first end is releasably connected such as by threads 26 to the brush attachment 12 whereby various types of brush attachments 12 may be attached as desired by the user. The cylindrical part 14 also includes a first dental floss guide 28 in the cavity 20 adjacent the first end of the part 14 for rotatably supporting one end of one of the spool ends 24 of the dental floss 22. The part 14 is of a diameter and length to provide an orthopedic gripping action giving the user maximum control and maneuverability.

The third part 16 is a cap for attachment to the second part 14 by means of a support platform 30.

Referring now to FIGS. 3–7 and 10, a support platform 30 having first and second sides is releasably attached to the second end of the cylindrical part 14 by a first threaded connection including threads 32 on the platform 30 and threads 34 (FIG. 2) on the part 14. The support platform 30 is releasably attached to the cap 16 by a second threaded connection consisting of a thread 38 on the platform 30 coacting with threads 40 in the end cap 16. The first side of the platform 30 includes a second dental floss guide 36 for rotatably supporting a second end of the spool end 24 for rotatably supporting the second end of the spool of dental floss 22. The platform 30 includes a dental floss opening 42 for the passage of dental floss 44 from the first side to the second side of the platform 30. Cutter means 46 are positioned on the second side of the support platform 30 for cutting the dental floss.

Figure 10:
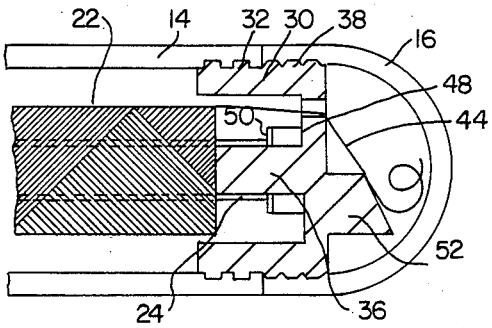
FIG. 10 is an enlarged cross-sectional view of the cap end of the present invention.

Preferably the first threaded connection consisting of the threads 32 and 34 for attaching the platform 30 to the second end of the cylindrical part 14 are oppositely directed to the second threaded connection consisting of the threads 38 and 40 for connecting the cap 16 to the platform 30. That is, one of the threaded connections is a righthanded connection and the other of the threaded connections is lefthanded threaded connection. Thus, the oppositedly directed threaded connections allow removal of the cap 16 without loosening of the support platform 30. Preferably the first threaded connection consisting of the threads 32 and 34 is a square thread connection for ease of makeup and release of the platform 30 from the part 14. It is to be noted that the cap 16 in its closed position, as best seen in FIGS. 3 and 10 abuts the second end of the part 14 for protecting the dental floss 44 and cutter 46 from contamination when they are not being used.

The spool ends 24 of the dental floss 22 are rotatably supported from the floss guides 28 and 36 for ease of rotation to provide smooth, tangle and jamming free, dispensing of the dental floss 44.

In order to provide the dental floss 22 with a cushion so as to prevent any rattling noise from occurring while brushing the teeth, a resilient washer 48, such as rubber, is positioned on the second dental floss guide 36 and preferably bonded on the platform 30 such as by glue. In addition, a low friction washer 50 may be positioned on the second dental floss guide 36 between the spool ends 24 and the resilient washer 48 and bonded to washer 48 for allowing ease of rotation of the dental floss 22.

Referring now to FIGS. 3, 4, 6–10, a projection 52 is provided extending outwardly from the second side of the support platform 30 for supporting the cutter 46. Preferably, the projection 52 includes locking notches 54 and 56. The cutter means 46 includes a metal base 58 having resilient fingers 60 and 62 for engaging the notches 54 and 56, respectively, for holding the cutter 46 on the projection 52. Preferably, the cutting means 46 includes dual cutters.

Figure 4:
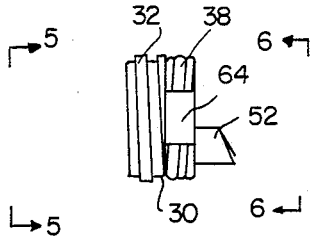
FIG. 4 is an elevational view of the support platform of the present invention.
Figure 5:
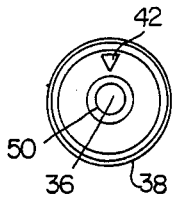
FIG. 5 is a cross-sectional view taken along the line 5—5 of FIG. 4.
Figure 6:
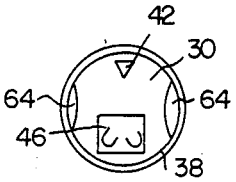
FIG. 6 is a cross-sectional view taken along the line 6—6 of FIG. 4.
Figure 7:
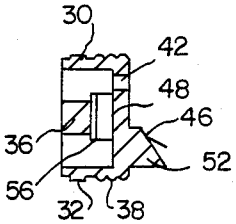
FIG. 7 is a cross-sectional view of the support platform of FIG. 4.
Figure 8:
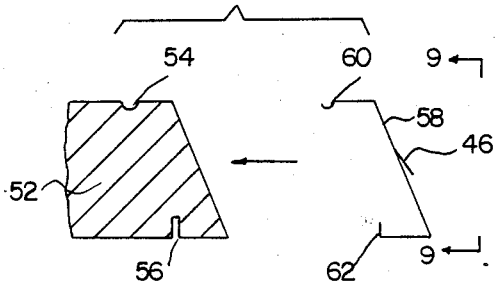
FIG. 8 is an enlarged exploded view showing the attachment of the front of cutter means on a projection on the support platform.
Figure 9:
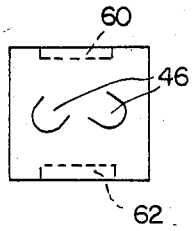
FIG. 9 is a cross-sectional view taken along the line 9—9 of FIG. 8.

Referring to FIGS. 4 and 6, the support platform 30 may include oppositely positioned indentations 64 for engagement for threading the platform 30 into and out of the second part 14.

In use, the combination toothbrush and dental floss holder 10 of the present invention provides for the easy removal and replacement of the brush attachment 12 by the threaded connection 26 to provide assorted brushes as desired. The parts 14 and 16 provide a handle with an enlarged diameter to provide maximum gripping action, control, and comfort for the user. Whenever desired, the dental floss 44 may be pulled out to the desired length and cut off by the cutter 46 after removing the end cap 16. When it is desired to insert or remove the roll of dental floss 22, the cap 16 and support platform 30 are removed, the end of the dental flow 44 is fed through the opening 42 and the device is reassembled.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. A combination toothbrush and dental floss holder, comprising:

a body having first, second and third parts, said first part being a toothbrush attachment, said second part having first and second ends and including a cavity for receiving a spool of dental floss, said first end releasably connected to the toothbrush attachment, said second part including a first dental floss guide adjacent the first end for rotatably supporting one end of a spool of dental floss, said third part being a cap for attachment to the second end of the second part, a support platform having first and second sides and releasably attached to the second end of the second part by a first threaded connection and releasably attached to the cap by a second threaded connection, said first side of the platform including a second dental floss guide for rotatably supporting a second end of a spool of dental floss, said platform including a dental floss opening for the passage of dental floss from the first side to the second side of the platform, a cutter positioned on the second side of the support platform for cutting the dental floss, a resilient washer positioned on the second dental floss guide for supporting the second end of a dental floss spool, and a low friction washer positioned on the second dental floss guide adjacent to said resilient washer for engaging the second end of a dental floss spool.

2. The apparatus of claim 1 wherein the first and second threaded connections are oppositely directed threads for allowing removal of the cap without loosening of the support platform.

3. The apparatus of claim 2 wherein the first threaded connection is a square thread for ease of makeup and release.

4. The apparatus of claim 1 wherein the second side of the support platform includes an outwardly directed projection supporting the cutter.

5. The apparatus of claim 4 wherein the projection includes locking notches and the cutter includes a metal base having resilient fingers for engaging the notches and holding the cutter on the projection.

6. The apparatus of claim 1 wherein said support platform includes oppositely positioned identations for engagement for threading the platform into and out of the second part.

* * * * *